US005303695A

United States Patent [19]

Shopsowitz

[11] Patent Number: 5,303,695

[45] Date of Patent: Apr. 19, 1994

[54] HUMAN FREE-FLIGHT LAUNCHER

[76] Inventor: Noah Shopsowitz, 16 Snowden Avenue, Toronto, Ontario, Canada, M4N 2A6

[21] Appl. No.: 973,763

[22] Filed: Nov. 9, 1992

[51] Int. Cl.[5] ..... F41B 7/00

[52] U.S. Cl. ..... 124/17; 124/20.1; 244/4 R; 244/63; 482/89; 472/128

[58] Field of Search ..... 244/4, 63; 446/63, 64, 446/65, 429, 430; 124/16, 20.1, 17; 482/89; 472/128, 129

[56] References Cited

U.S. PATENT DOCUMENTS

| | | | |
|---|---|---|---|
| D. 160,257 | 9/1950 | Gilmore . | |
| 562,448 | 6/1896 | Zedora . | |
| 824,506 | 6/1906 | Obiols . | |
| 826,019 | 7/1906 | Crosse . | |
| 2,282,315 | 5/1942 | Adams . | |
| 2,307,125 | 1/1943 | Goddard | 244/63 |
| 2,444,919 | 7/1948 | Cotton et al. | 244/63 |
| 3,227,878 | 1/1966 | Nairn et al. . | |
| 3,466,053 | 9/1969 | Whaley . | |
| 4,240,396 | 12/1980 | Randoll . | |
| 4,261,319 | 4/1981 | Dixon . | |
| 4,431,182 | 2/1984 | Reynolds . | |
| 5,067,471 | 11/1991 | Kim . | |

FOREIGN PATENT DOCUMENTS

| | | | |
|---|---|---|---|
| 632976 | 7/1936 | Fed. Rep. of Germany . | |
| 468032 | 12/1951 | Italy | 124/17 |
| 654816 | 6/1951 | United Kingdom . | |

*Primary Examiner*—Galen L. Barefoot
*Attorney, Agent, or Firm*—Fisher Christen & Sabol

[57] ABSTRACT

A human free-flight launcher including a seat positioned within a tetrahedral frame and supported therein by elasticized cords which, upon retraction of the seat within the interior of the tetrahedral support frame, come under tension to cause the seat, upon its release, to be propelled forward launching the person seated therein into free-flight through an open face of the tetrahedral support frame.

15 Claims, 5 Drawing Sheets

HUMAN FREE-FLIGHT LAUNCHER

BACKGROUND OF THE INVENTION

The present invention relates generally to a mechanism for propelling, launching or throwing objects. More specifically, the invention relates to a mechanism for safely throwing a person so that they may experience the thrill and sensation of acceleration and free-flight through the air, landing on a suitable surface such as padding or in water.

It is possible for people to experience the sensation of free flight through a number of varied popular activities. For example, bungee jumping has recently gained some popularity, but also activities which include the use of ski jumps, diving, trampolines or, indeed, jumping from a safe height into snow or water. The free fall part of skydiving, as with bungee jumping, is a satisfying way to experience weightlessness for an expended period of time.

A number of mechanisms for projecting or throwing humans and inanimate objects are known. U.S. Pat. No. 562,448, issued on Jun. 23, 1896 to Zedora, discloses a means for projecting a person for the amusement of spectators at events such as carnivals and fairs. It consists of a "bow and arrow" like arrangement in which the person to be thrown is launched like an arrow. As such, this type of device is likely only suitable for use by professional acrobats and the person to be thrown would require considerable physical strength and expertise.

U.S. Pat. No. 824,506, issued on Jun. 26, 1906 to Obiols, shows a more complex and sophisticated device which could conceivably be used for throwing a person. This device uses compressed helical springs with a cable and a wheel arrangement.

U.S. Pat. No. 826,019, issued Jul. 13, 1906 to Crosse, shows an apparatus for throwing "projectiles of any kind", including people. The device is a cannon which uses a gas driven piston to propel the occupant. It is clear, once again, that this type of device is used for the amusement of observers and not the person being projected. Considerable skill, strength and stamina would be required by the person using the device.

U.S. Pat. No. 3,466,053, issued Sep. 9, 1969 to Whaley, shows a form of a caterpult designed to launch a person and would be used in combination with a swimming pool as a means for providing a landing for the person. This device is of relatively complex and rugged construction and comprises a caterpult and seat arrangement. A device of this type is not readily adapted for easy storage, transportation and assembly, nor use, for example, at a beach.

U.S. Pat. No. 4,431,182, issued Feb. 14, 1984 to Reynolds, discloses a number of Human Free-Flight Amusement Devices. Of interest is the use of a cradle for launching a person by means of a pneumatic actuator. Again, the device disclosed is of rugged and sophisticated construction, and not adopted for easy storage or quick movement and assembly. Furthermore, a device of this nature would require comprehensive maintenance and again would not be suitable for use at a number of different locations.

U.S. Pat. No. 3,277,878, issued Apr. 27, 1964 to Pankratz, U.S. Pat. No. 4,240,396, issued Dec. 23, 1980 to Randall, U.S. Pat. No. 4,261,319 issued Apr. 14, 1981 to Dixon, U.S. Pat. No. 5,067,471 issued Nov. 26, 1991 to Kim, and U.K. Patent Publication 654,816, published Jun. 27, 1951 all relate to sling-like launching devices for balls. However, these devices do not disclose or suggest that they can be safely used for human free-flight.

Generally, the known throwing devices for human free-flight have been designed for use by carnival performers such as acrobats. Once launched, the person may be caught in a net, land on mats, or catch a trapeze bar. Safe use of both the launch and retrieval methods requires considerable training and skill and such devices are therefore not suitable for use by very many people. While it is possible for a wider range of people to experience free flight through, for example sky diving or bungee jumping, such activities require specialized equipment, training, and particular surroundings and environmental conditions; once again limiting their availability to those with the time, money, and inclination to pursue them.

In view of the foregoing, it will be recognized that there may be a large number of people who have a desire to experience the sensations of free-flight without sophisticated equipment, but still with a high degree of safety. It is also clear that the desire has not been satisfied by the prior art in a device which is relatively easy to assemble and use at locations such as a beach or swimming pool.

In order to safely use the present invention, it is necessary that the persons launched into free-flight be able to land safely. The simplest form of landing media is water, in a suitable location in the ocean at beach-side or in a swimming pool. When used at the beach, the person being launched can either swim back to the shore unassisted, carry a small foam raft with them, or be collected by a boat.

In other locations apparatus such as safety nets, inflated pads, foam pads, inflated and vented pads could also be used.

As with all devices which require some form of physical conditioning and present an element of danger, safety precautions must always be taken. For example, the launcher must only be used where there is an open flight path and a sufficiently safe landing area is available. Emergency medical assistance should be available, in the unlikely circumstance an injury arises. These requirements are, of course, obvious and are taken where any form of sporting activity is undertaken (for example skiing, race car driving, bungee jumping, etc.).

It is further understood that the apparatus of the present invention would be inspected and maintained frequently to ensure that the safety of the components is in no way compromised.

The object of the present invention is to provide an improved human free-flight device. This invention is particularly directed towards offering people the experience of free-flight without any of the specialized knowledge of free-flight or skill which is required of an acrobat or carnival performer.

It is a further object of the invention to provide a device of lightweight structure which is portable and easy to construct and operate.

SUMMARY OF THE INVENTION

The invention provides a free-flight launcher, comprising: a support frame with a base and at least one upright support member, a cradle for releasably holding a person to be launched into free-flight; an elastic means for securing the cradle to the support frame; and a means for retracting the cradle from a rest position to a launch position and thereby tensioning the elastic means, the arrangement being such that upon release of the cradle from the launch position, said cradle is propelled forward with the person contained therein being launched from the cradle when the elastic means reaches a maximum forward extension.

The invention also provides a free-flight launcher, comprising: a support frame with a base and at least two upright support members; a cradle for releasably holding a person to be launched into free-flight; an elastic means for securing the cradle to the support frame; and a means for retracting the cradle from a rest position to a launch position and thereby tensioning the elastic means, the arrangement being such that upon release of the cradle from the launch position, said cradle is propelled forward with the person contained therein being launched from the cradle when the elastic means reaches a maximum forward extension.

The invention still further provides a free-flight launcher, comprising a tetrahedral support frame; a cradle for holding an object to be launched into free-flight; an elastic means for securing the cradle to the support frame; a means for retracting the cradle to tension the elastic means; the arrangement being such that upon release of the cradle under tension, it is propelled forwards with the object contained therein being launched from the cradle exterior the frame when the elastic means reaches a maximum forward extension.

In one particularly useful embodiment of this invention the support frame is tetrahedrally shaped and the elastic means is provided by elasticized cords attached to the cradle and each corner of one triangular face of the tetrahedrally shaped support frame.

BRIEF DESCRIPTION OF THE DRAWINGS

The following is a description by way of example of the preferred embodiments of the present invention, reference being had to the accompanying drawings in which.

DETAILED DESCRIPTION OF THE DRAWINGS

Figure 1:
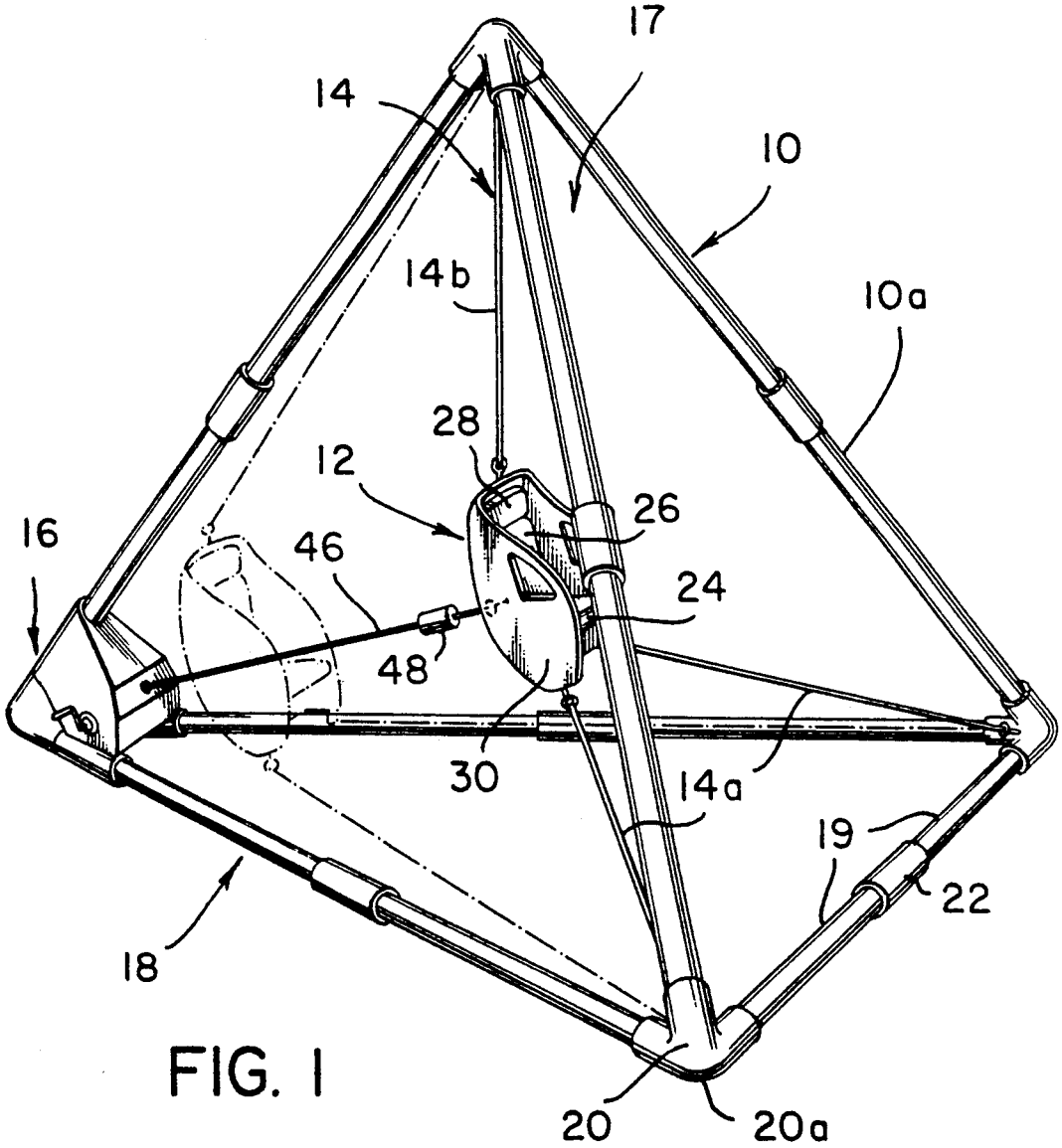
FIG. 1 is a perspective view of the human free-flight device according to the present invention, with the seat in the rest position and also shown in ghost in the retracted position.

Referring to the drawings, illustrated is a human free-flight launcher according to the present invention, including a support frame 10, cradle 12, elastic means 14 and a retraction means 16.

In a first embodiment, the frame 10 is constructed in the shape of a tetrahedron as tetrahedral frame 10*a*, having four open equilateral triangular faces 17, using six tubular frame members 18 and four angular corner connections 20. The tubular frame members 18 are of two piece construction using members 19 joined by turnbuckle sleeves 22. Each of the angular corner connections 20 forms an integral corner 20*a* of tetrahedral frame 10*a* and receives two of the frame members arranged horizontally, at an acute angle, and a third member 18 at an acute vertical angle into apertures therein (not shown). The members 19 are preferably threaded at either end so that they may be screwed into both the turnbuckles 22 and also the angular corner connections 20, which may also be threaded. The members 19, angular corners 20 and turnbuckles 22 are preferably manufactured from aluminium or steel, although suitably rigid plastics or carbon fibre composites could be used.

Figure 4:
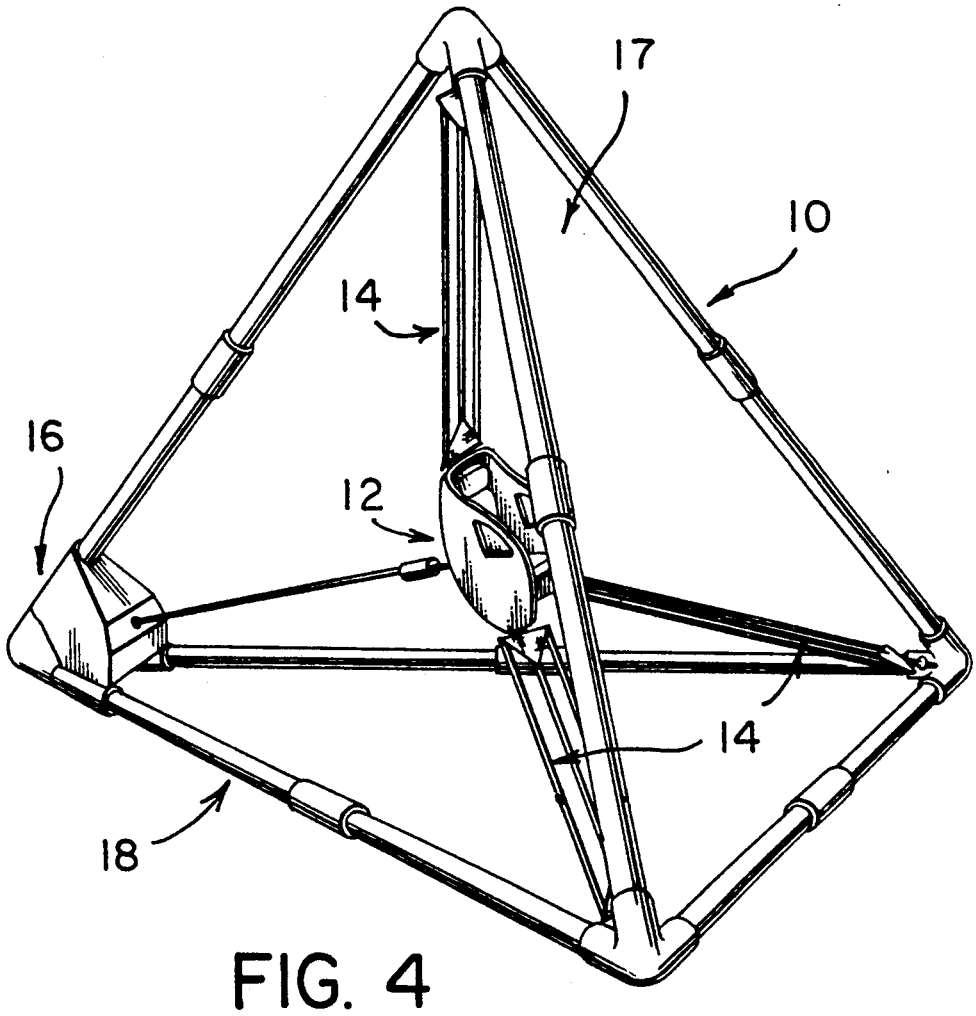
FIG. 4 is a perspective view of a variant of the device shown in FIG. 1.

The cradle 12 comprises a seat 24, back 26, head support 28 and side support walls 30 and is shaped to firmly support the body of the person to be seated therein. It is preferably mounted within the tetrahedral frame 10*a* by the elastic means 14 which is at least three elasticized cables which are each attached to the corner connections 20 of one triangular face 17 of tetrahedral frame 10*a*. Two bottom cables 14*a* are attached to the bottom of the cradle 12 by attaching one cable to each of the bottom side support walls 30 and the opposite ends to the adjacent corner connection 20 of the triangular face 17 of the tetrahedral frame 10*a*; one end of a third cable 14*b* is attached to the top of the back 26 of the cradle 12 and the opposite end to the corner connection 20 at the apex of the triangular face 17 and tetrahedral frame 10*a*. The cables 14*a* and *b* are all preferably fastened to both the frame 10*a* and cradle 12 by means of shackles or snap shackles using eyelets 38 formed on the cradle 12 and at the centre of the angular corner connections. The corner 20*a* of frame 10*a* immediately behind cradle 12 is preferable provided with retraction means 16, as best seen in FIGS. 1 and 4. One type of retraction means, as illustrated, is a commercially available winch 39. The winch 39 and cradle 12 are connected by a retraction cable 46, one end of which is fastened to and wound around the winch drum 42, and the other end fastened to the rear of the cradle 12. The retraction means can be operated manually, by for example a hand-cranked winch or bicycle powered crank, or motorized by means of an electric motor.

Figure 3A:
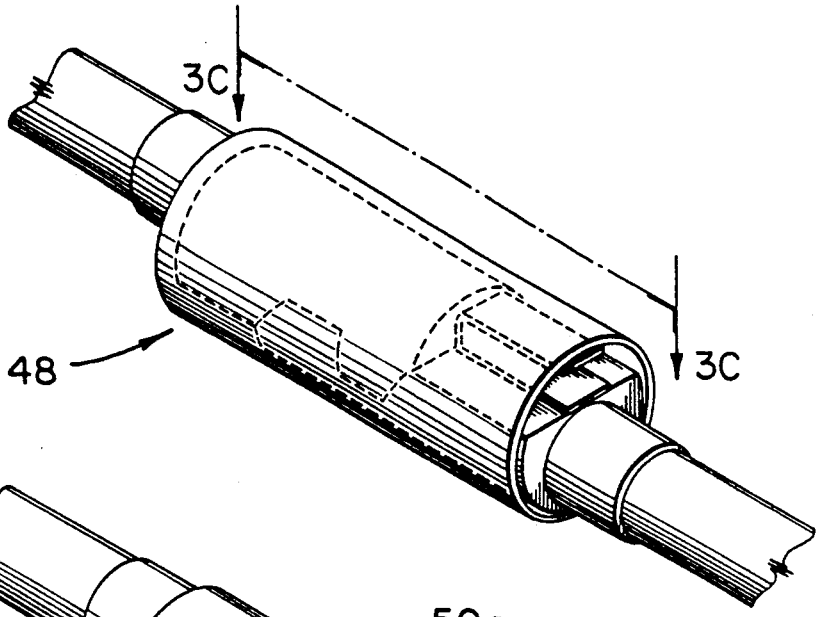
FIG. 3A is a perspective view of the release means shown in FIG. 1.
Figure 3B:
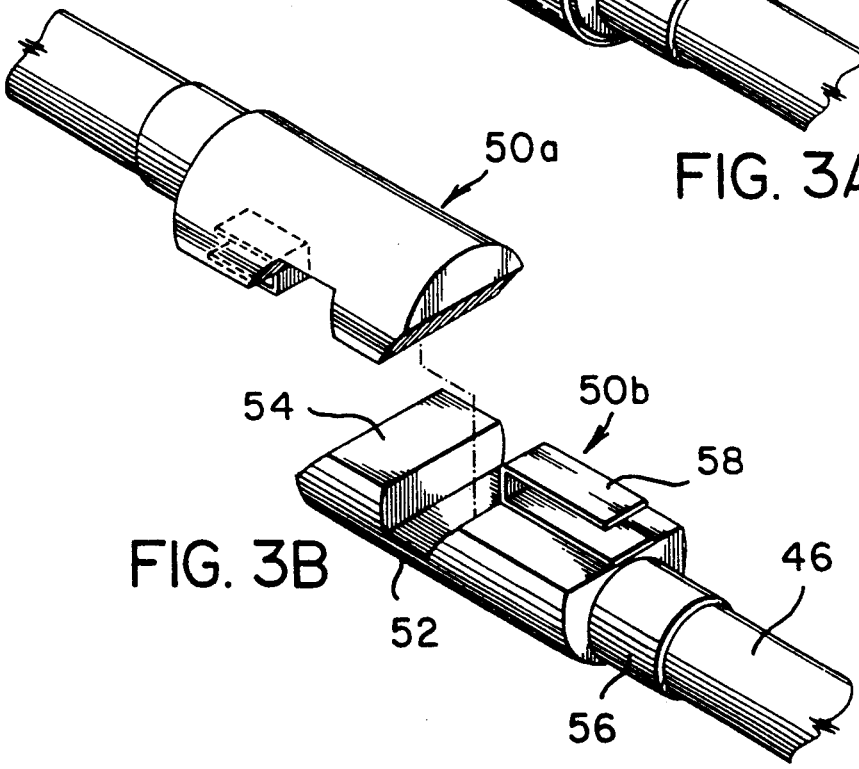
FIG. 3B is a perspective view of the release means with the sleeve removed.
Figure 3C:
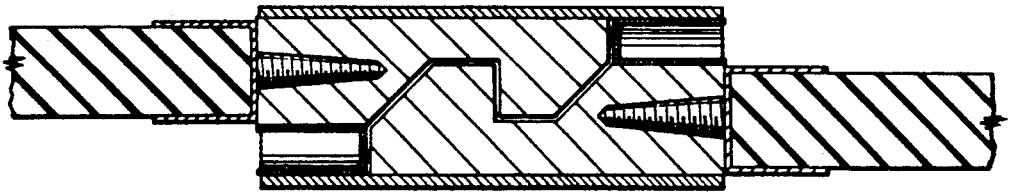
FIG. 3C is a cross-section along line 3C of FIG. 3A.

The retraction cable 46, in a position immediately behind cradle 12, preferably has a release means 48. The release means 48 comprises two opposed generally inverted "L-shaped" latch teeth 50*a* and *b* which mate with one another, each identical latch tooth having a side limb 52 and a top limb 54. The side limb 52 of each latch tooth 50*a* and 50*b* is attached to an anchorage block 56 which, in turn, is fastened to one end of cable 46. Adjacent to the side limb 52 of latch tooth 50 there is a "U-shaped" compression spring 58, one side of which abuts the anchorage block 56 and the other a tubular sleeve 60 which surrounds the latch teeth 50, as best seen in FIGS. 3A and 3C.

The device of the present invention may be quickly assembled using the members 19, turnbuckle sleeves 22 and angular corner connections 20. The base of the tetrahedral frame is constructed first by connecting three tubular frame members 18, each composed of two members 19, to three angular corner connections 20 to form an equilateral triangle, horizontal to and resting upon the ground. The three remaining tubular frame members 18 are each then connected to the vertical aperture of each angular corner connection 20 and rise upwards to meet at an apex where they are connected by a fourth angular corner connection 20.

Prior to launch, the base of the frame 10 is suitably anchored to the ground using "U-shaped" spikes, or some such fastening means, over the frame members 18 resting on the ground. The frame 10*a* may also be used on water and, in this embodiment, the members and corners of the base of the tetrahedral frame 10*a* can be provided with suitable flotation devices (not shown).

Figure 2:
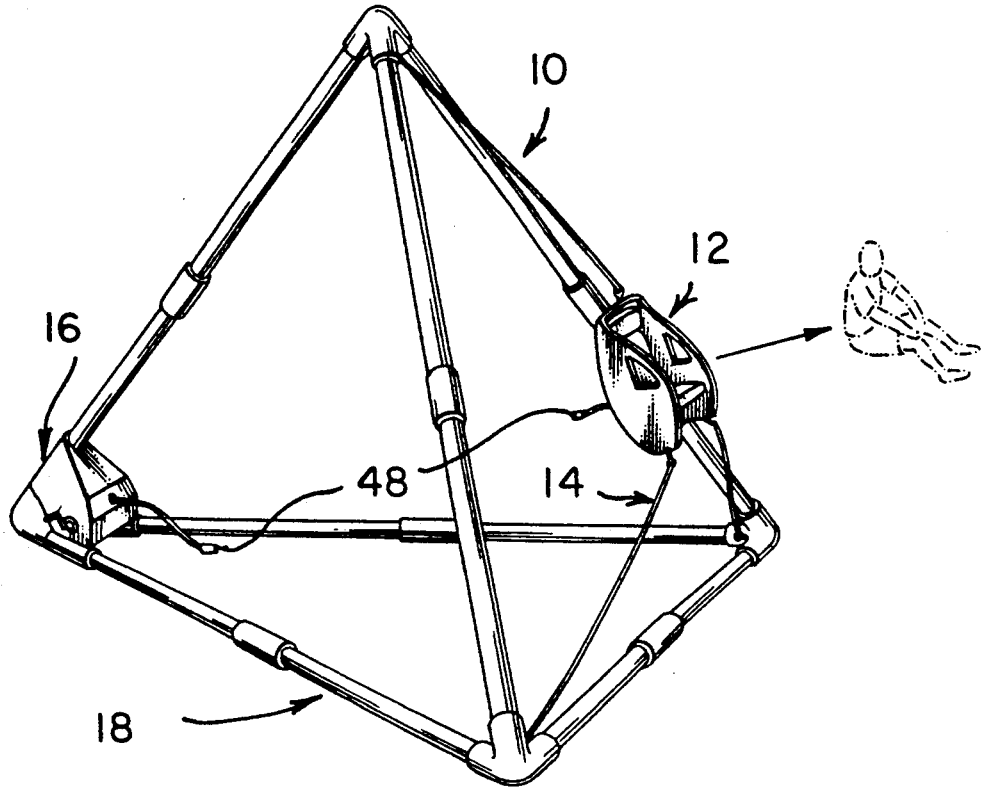
FIG. 2 is a perspective view of the device showing the seating means in the fully extended launch position.
Figure 2A:
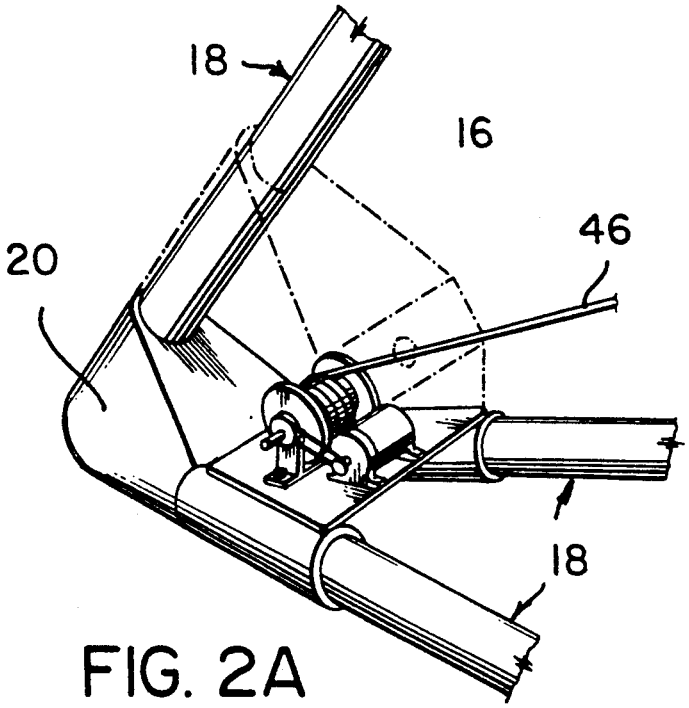
FIG. 2A is a perspective view of the retraction means shown in FIG. 2 ,with the retraction means housing shown in ghost.

In order to ready the apparatus for launch, the latch teeth 50 of the release means 48 are joined and tubular sleeve 60 is slid into place over the teeth 50 to prevent disengagement; the retraction means 16 is then activated. Once the slack on the retraction cable 46 has been taken-up, the cradle 12 is pulled from its rest position (as seen in FIG. 1) to the launch position (as shown in ghost in FIG. 1). As the seat is retracted the elasticized cables 14*a* and *b* are stretched under pressure. Once in the launch position the person to be launched into free flight mounts the cradle 12 and, upon instruction, the release means 48 is triggered. The release means is triggered by either pulling or pushing the sleeve 60 in the axial direction of the retraction cable 46. This allows the latch teeth 50*a* and *b* to disengage and, upon disengagement, the cradle 12 is propelled forward under force of cables 14*a* and *b* as best seen in FIG. 2. As the seat and occupant are accelerated forward, the cables 14 reach their maximum extension, this causes the cradle 12 to decelerate, remaining attached to the frame, while the occupant continues in upward and forward motion (free flight). The upward and forward motion eventually slow to zero and thus becomes downward movement under the effect of gravity, at which point the person lands in a suitable receiving area.

The launch position, or the distance which cradle 12 is retracted under tension of the cables 14*a* and *b* which are stretched, can be varied depending upon the distance to be travelled by the individual to be launched into free-flight. The distance to be travelled is a function of body weight and the tension in the cables, varying distances of travel can easily be calculated based upon trials for different variables. It is also possible to include a sensor on one or more of the cables 14 to measure the degree of tension, rather than relying upon the amount of retraction as a measure.

Figure 5:
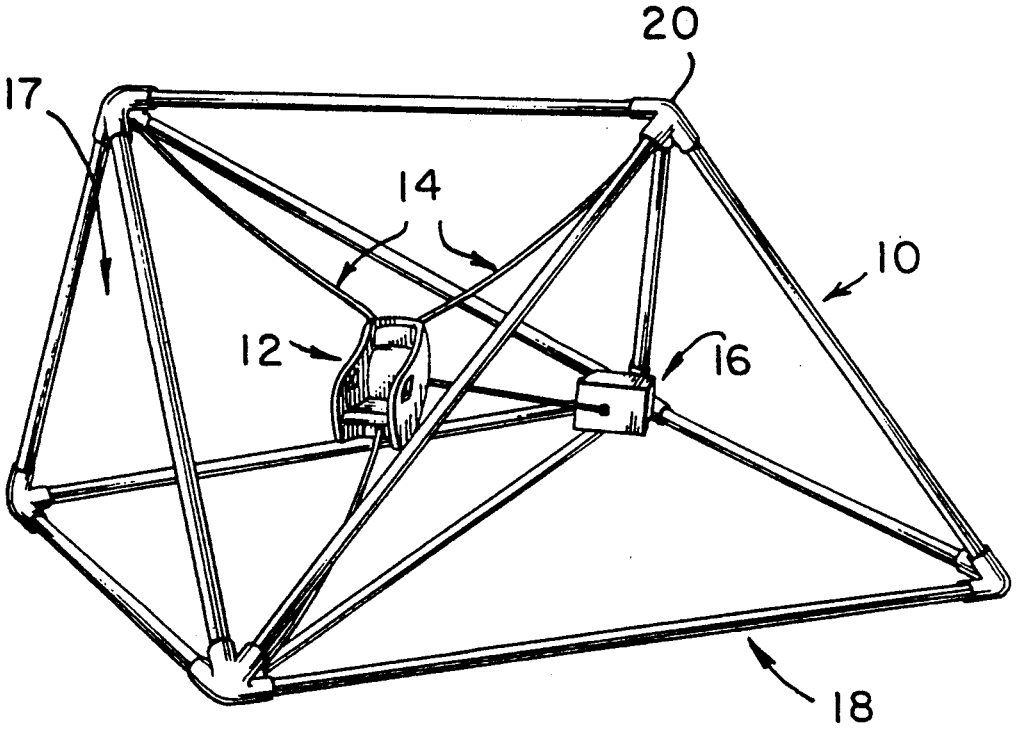
FIG. 5 is a perspective view of a second variant of the device shown in FIG. 1.

As described above, the frame 10 is preferably constructed of tubular members as a tetrahedron, however, other frame shapes and constructions are possible such as the embodiment shown in FIG. 5 which is a triple tetrahedron, or as a regular solid such as a cubic frame, or even a geodesic dome could be used, all possibly constructed from trussed members.

Furthermore, various sizes of construction are possible depending upon the intended use of the device. Where the free-flight distance to be travelled is relatively short, as for example at pool-side, a relatively small scale frame can be constructed. In contrast, where the device is to be used at ocean side and greater distance is required, a larger frame can be constructed.

In the foregoing specification a preferred embodiment and method of use of the present invention have been described; however, it will be understood that this invention may be otherwise embodied within the scope of the following claims.

What I claim as my invention:

1. A free-flight launcher comprising a tetrahedrally shaped support frame, a cradle for releasably holding a person to be launched into free-flight, an elastic means for securing the cradle to each corner of one triangular face of the tetrahedrally shaped support frame, and means for retracting the cradle from a rest position to a launch position and thereby tensioning the elastic means, the arrangement being such that upon release of the cradle from the launch position, said cradle is propelled forward with the person contained therein being launched from the cradle when the elastic means reaches a maximum forward extension.

2. A free-flight launcher according to claim 1 wherein the elastic means are elasticized cords.

3. A free-flight launcher according to claim 1 wherein the means for retracting the cradle is a manually operated winch.

4. A free-flight launcher according to claim 1 wherein the means for retracting the cradle is a winch driven by an electric motor.

5. A free-flight launcher according to any one of claims 1, 2, 3 or 4 having a release means for releasably securing the cradle to the means for retracting the cable.

6. A free-flight launcher according to claim 5 wherein said release means comprises a latch operable for releasing the cradle from the launch position.

7. A free-flight launcher according to claim 1 wherein the support frame comprises tubular members manufactured from either aluminum, steel, plastics or carbon fiber composites.

8. A free-flight launcher according to claim 1 wherein the support frame is mounted within a surrounding support structure.

9. A free-flight launcher comprising a support frame shaped as a regular solid, a cradle for releasably holding a person to be launched into free-flight, at least three elasticized cords for securing the cradle within one of the faces of the support frame, and means for retracting the cradle from a rest position to a launch position and thereby tensioning the elastic means, the arrangement being such that upon release of the cradle from the launch position, said cradle is propelled forward with the person contained therein being launched from the cradle when the elastic means reaches a maximum forward extension.

10. A free flight launcher comprising:

a) a support frame, said frame comprising support members which form an open face, b) elasticized cords attached to the support members forming said open face at three different positions, c) a cradle for releasably holding a person to be launched into free-flight, said cradle being attached to said frame by means of said elasticized cords, and d) means for retracting the cradle from a rest position to a launch position and thereby tensioning the elastic means, the arrangement being such that upon release of the cradle from the launch position, said cradle is propelled through said open face with the person contained therein being launched from the cradle when the elastic means reaches a maximum forward extension.

11. A free flight launcher as claimed in claim 10 wherein said open face is triangular.

12. A free flight launcher as claimed in claim 10 wherein said open face is square.

13. A free flight launcher as claimed in claim 10 wherein said frame is constructed of tubular members as a triple tetrahedron.

14. A free flight launcher as claimed in claim 10 wherein said cradle comprises a seat, a back attached to said seat, a head support attached to said back for supporting a person's head, and side support walls, and said elasticized cords are attached above said head support and below said seat.

15. A free flight launcher as claimed in claim 10 wherein said cradle is releasably secured to said means for retracting by a release means, said release means comprising two opposed latches which mate with each other, said latches being surrounded by a sleeve which holds the latches in mating engagement, said latches being disengaged by movement of said sleeve relative to said latches.

* * * * *